US009172177B2

(12) United States Patent
Ludwig et al.

(10) Patent No.: US 9,172,177 B2
(45) Date of Patent: Oct. 27, 2015

(54) STRAIN-RELIEF/BENDING-PROTECTION APPARATUS

(75) Inventors: Martin Ludwig, Wuppertal (DE); Necdet Papurcu, Datteln (DE)

(73) Assignee: Delphi Technologies, Inc., Troy, MI (US)

( * ) Notice: Subject to any disclaimer, the term of this patent is extended or adjusted under 35 U.S.C. 154(b) by 72 days.

(21) Appl. No.: 14/117,075

(22) PCT Filed: Mar. 30, 2012

(86) PCT No.: PCT/EP2012/055781

§ 371 (c)(1), (2), (4) Date: Nov. 12, 2013

(87) PCT Pub. No.: WO2012/152505

PCT Pub. Date: Nov. 15, 2012

(65) Prior Publication Data

US 2014/0295694 A1 Oct. 2, 2014

(30) Foreign Application Priority Data

May 12, 2011 (EP) ..... 11003937

(51) Int. Cl.
*H01R 13/58* (2006.01)

(52) U.S. Cl.
CPC ..... *H01R 13/5845* (2013.01); *H01R 13/5841* (2013.01)

(58) Field of Classification Search
CPC .. H01R 13/58; H01R 13/582; H01R 13/5841; H01R 13/5845
USPC ..... 439/449, 452, 456, 457
See application file for complete search history.

(56) References Cited

U.S. PATENT DOCUMENTS

| | | | | |
|---|---|---|---|---|
| 4,133,971 | A * | 1/1979 | Boyd et al. | 174/46 |
| 4,641,899 | A * | 2/1987 | Gallusser et al. | 439/597 |
| 5,138,678 | A * | 8/1992 | Briggs et al. | 385/86 |
| 5,315,062 | A * | 5/1994 | Hoshino | 439/446 |
| 6,019,645 | A * | 2/2000 | Avery et al. | 439/752 |
| 6,338,645 | B1 * | 1/2002 | Tan et al. | 439/446 |
| 7,422,443 | B2 * | 9/2008 | Kaneko et al. | 439/76.2 |
| 2002/0141723 | A1 * | 10/2002 | Kent et al. | 385/136 |

FOREIGN PATENT DOCUMENTS

| | | | |
|---|---|---|---|
| DE | 18 97 976 | U | 8/1964 |
| DE | 30 39 257 | A1 | 4/1982 |
| DE | 10 2006 046049 | A1 | 4/2008 |
| EP | 0 419 766 | A1 | 4/1991 |

OTHER PUBLICATIONS

International Search Report dated Jul. 5, 2012.

* cited by examiner

*Primary Examiner* — Khiem Nguyen
(74) *Attorney, Agent, or Firm* — Robert J. Myers

(57) ABSTRACT

The invention relates to a strain relief/bending protection apparatus for a cable, in particular a high speed cable, connected to a plug connector, comprising a base section which can be fastened to a housing of the plug connector and a sleeve section projecting from the base section for surrounding the cable in a region disposed outside the housing, wherein the sleeve section continuously has a round cross-section and the cross-sectional area of the sleeve section reduces as the spacing from the base section increases.

6 Claims, 2 Drawing Sheets

(A)

(B)

(C)

STRAIN-RELIEF/BENDING-PROTECTION APPARATUS

CROSS-REFERENCE TO RELATED APPLICATION

This application is a national stage application under 35 U.S.C. §371 of PCT Application Number PCT/EP2012/055781 having an international filing date of Mar. 30, 2012 which designated the United States, the entire disclosure of which is hereby incorporated herein by reference.

TECHNICAL FIELD OF THE INVENTION

The invention relates to a strain relief/bending protection apparatus for a cable, in particular a high-speed cable, connected to a plug connector, said strain relief/bending protection apparatus comprising a base section which can be fastened to a housing of the plug connector and a sleeve section projecting from the base section for surrounding the cable in a region disposed outside the housing.

BACKGROUND OF THE INVENTION

Strain relief/bending protection apparatus are generally known and should prevent damage to the cable in the transition region to the plug connector housing.

In a known strain relief/bending protection apparatus, the sleeve section has a cylindrical design and such a high stiffness that the section of the cable surrounded by the sleeve section cannot move at least substantially relative to the plug connector housing under normally occurring forces. This means that the cable always bends in the same region on a deflection relative to the plug connector housing, namely directly outside the sleeve section, whereby there is an increased risk of a cable break.

It is known for the provision of a certain elasticity of the sleeve section to introduce incisions oriented transversely to the cable direction into the sleeve section, with the incisions being able to be formed on oppositely disposed sides of the sleeve section or peripherally. However, due to the incisions, the manufacture of such strain relief/bending protection apparatus is associated with an increased economic effort. If, for example, the apparatus are manufactured using an injection molding process, the introduction of the incisions into the sleeve section typically takes place with the aid of sliders which have to be pushed into the injection mold used for manufacturing the apparatus, i.e. the injection mold has a more complex design.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, a strain relief/bending protection apparatus for a cable connected to a plug connector is provided. The strain relief/bending protection apparatus includes a base section configured to be fastened to a housing of the plug connector and a sleeve section projecting from the base section for surrounding the cable in a region disposed outside the housing. The sleeve section has a continuously round cross-section. A cross-sectional area of the sleeve section reduces as the spacing from the base section increases. A cross-sectional surface of the sleeve section decreases step-wise while forming discrete part sections, with the cross-sectional area between two part sections decreasing constantly. In one embodiment, the sleeve section does not have any incisions. The lengths of at least two part sections may be different. The cross-sectional area of the sleeve section may be circular, oval, or ellipsoid. The sleeve section may be angled relative to the base section.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
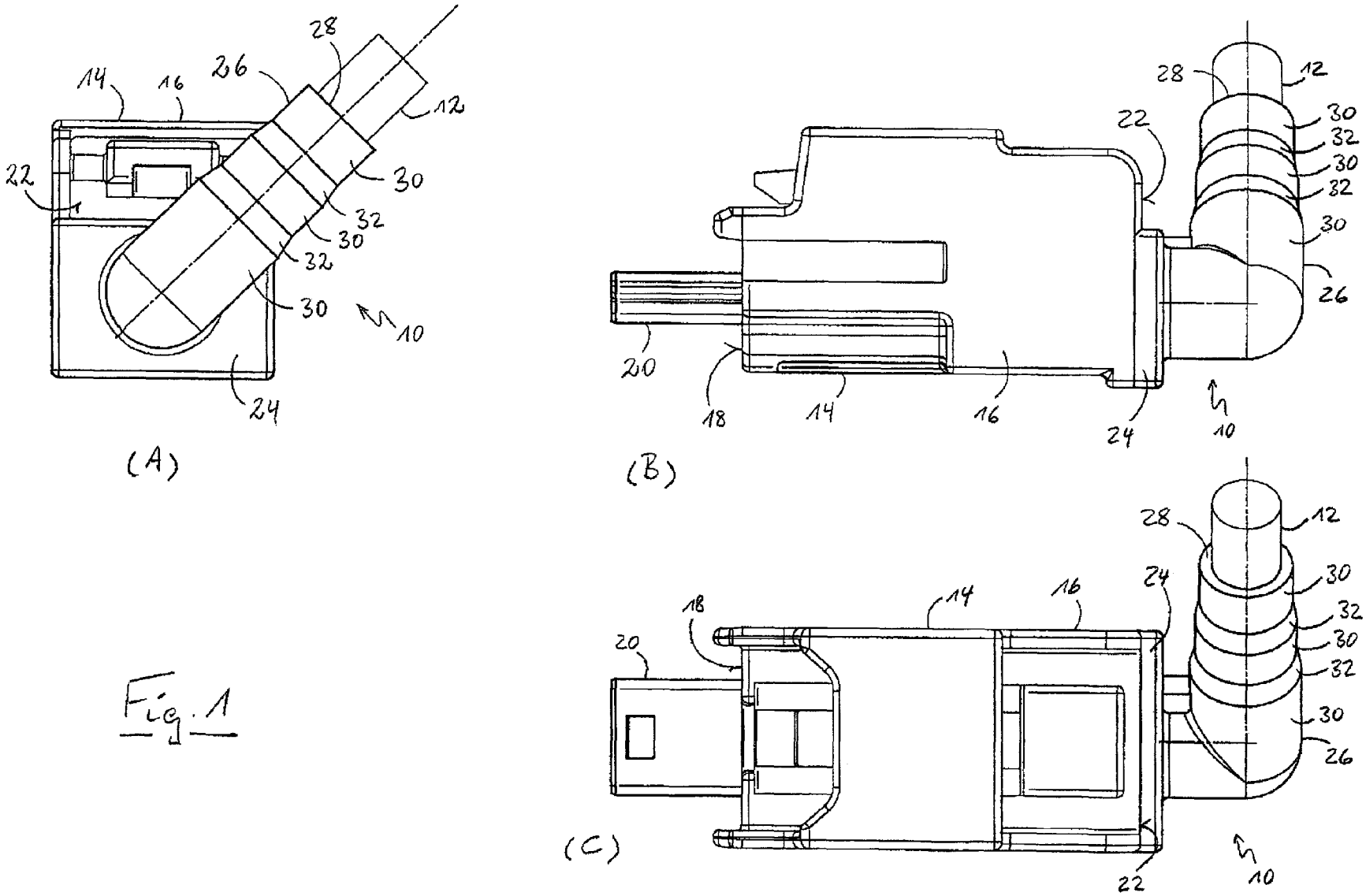
FIG. 1A is an end view of a strain relief/bending protection apparatus in accordance with the invention in accordance with a first embodiment.
FIG. 1B is a side view of a strain relief/bending protection apparatus in accordance with the invention in accordance with a first embodiment.
FIG. 1C is a top view of a strain relief/bending protection apparatus in accordance with the invention in accordance with a first embodiment.

It is the underlying object of the invention to provide a strain relief/bending protection apparatus which can be manufactured with a minimal economic effort and which in so doing provides ideal protection against cable breakage.

The object is satisfied by a strain relief/bending protection apparatus having the features of claim 1 and in particular in that the sleeve section continuously has a round cross-section and the cross-sectional area of the sleeve section decreases as the spacing from the base section increases.

In accordance with the invention, the cross-sectional area of the sleeve section reduces step-wise, whereby a plurality of discrete part sections are formed.

The cross-sectional area of the sleeve section furthermore reduces constantly between two part sections. This is advantageous when the apparatus is manufactured by means of an injection molding process since then the transition between two part sections is not abrupt, but is rather formed by a slanted surface or by a cone-shaped shell surface. The formation of undercuts during the injection molding can hereby be prevented.

The tapering of the sleeve section in accordance with the invention in the direction of its free end remote from the base section provides the sleeve section with an elasticity which increases in the direction of its free end so that the sleeve section can already bend together with the cable on exertion of smaller deflection forces onto the cable with a corresponding dimensioning, i.e. with a corresponding wall thickness or with a corresponding reduction in the wall thickness toward the free end. In this respect, the bending point of the cable migrates further and further in the direction of the base section with an increasing deflection force due to the increasing cross-sectional area of the sleeve section in the direction of the base section, i.e. there is no fixed bending point, but rather a migrating bending point, whereby the risk of a cable break is considerably reduced.

In accordance with the invention, the sleeve section has a round cross-section, i.e. it has no edges which would result in an increased stiffness of the sleeve section in specific directions of deflection. Instead, an ideal elasticity extent of the sleeve section is achieved by the round cross-section of the sleeve section in all directions transverse to the cable direction, i.e. the apparatus in accordance with the invention does not have any preferential directions in which a better protection is achieved, but rather an ideal protection against cable breakage is ensured on deflections of the cable in any desired directions transversely to the cable direction.

Due to its round cross-section, the sleeve section moreover has a particularly simple geometrical shape which can be easily realized, for example, by means of an injection molding process, whereby the apparatus in accordance with the invention can be manufactured with a minimal economic effort.

The cable does not necessarily have to be an electric cable such as a high speed cable provided for data transfer. The apparatus in accordance with the invention can rather also be used in conjunction with an optical cable, e.g. a fiber optic cable.

Advantageous embodiments of the invention can be seen from the dependent claims, from the description and from the drawing.

In accordance with a preferred embodiment, the sleeve section does not have any incisions or cut-outs. This contributes to a simpler geometrical design and thus ultimately to a less expensive manufacturing capability of the apparatus. An injection mold provided for manufacturing the apparatus in particular does not have to be equipped with additional means for introducing incisions or cut-outs, e.g. sliders, i.e. a simpler injection mold can be used.

The lengths of the part sections, i.e. their dimensions viewed in the cable direction, can generally all be the same. The lengths of at least two part sections are, however, preferably different. The bending behavior and thus the desired protective function of the apparatus can be directly matched to the cable by a suitable choice of the lengths of the part sections while taking account of their respective wall thicknesses, i.e. of the cross-sectional area of the sleeve section in the region of the respective part section, which contributes to an ideal protective function.

If the cable has a circular cross-section, it is advantageous if the cross-section of the sleeve section is also circular since an ideal bending protection in all directions transverse to the cable direction results in this case. It is, however, generally also possible to select the cross-section of the sleeve section as oval or ellipsoid, for example when the cable comprises two round cables extending next to one another or when the cable has a generally flattened cross-section.

FIGS. 1A-1C show a first embodiment of a strain relief/bending protection apparatus 10 which is provided for the protection of a cable 12, in the present embodiment of a high speed cable having a substantially circular cross-section. The cable 12 is connected to a plug connector 14 which has a housing 16. A plug-in contact 20, in the present embodiment a universal serial bus (USB) jack or a low voltage differential signal (LVDS) jack, projects at a front side 18 of the housing 16. The central axis of the plug-in contact 20 coincident with the plug-.in direction of the plug-in contact 20 defines a main axis of the plug connector 14.

The strain relief/bending protection apparatus 10 is fixedly attached to a rear side 22 of the housing 16 disposed opposite the front side 18. The strain relief/bending protection apparatus 10 can, for example, be injection molded, adhesively bonded or welded to the housing 16.

The strain relief/bending protection apparatus 10 is a plastic component manufactured by an injection molding apparatus and formed in one piece. The strain relief/bending protection apparatus 10 comprises a base section 24 which is in contact with the housing 16 and a sleeve section 26 which projects from the base section 24 and surrounds a section of the cable 12 extending outside the housing 16 over a certain length.

In the embodiment shown in FIGS. 1A-1C, the sleeve section 26 extends at a right angle to the main axis of the plug connector 14, i.e. the cable 12 is introduced into the housing 16 at an angle of 90°. In addition, the sleeve section 26 is tilted by approximately 45° relative to a plane defined by the plug-in contact 20.

Figure 2:
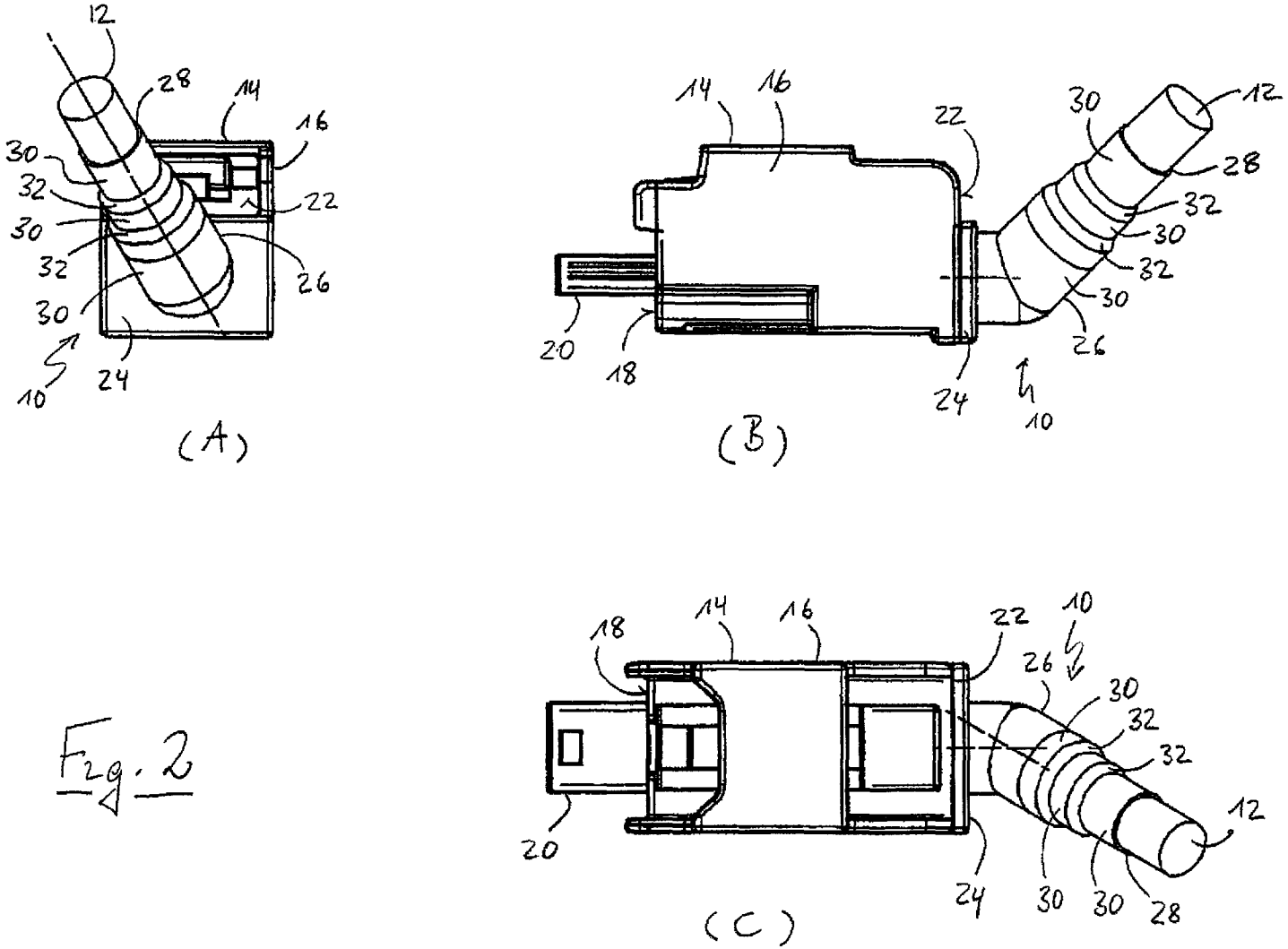
FIG. 2A is an end view of a strain relief/bending protection apparatus in accordance with the invention in accordance with a second embodiment.
FIG. 2B is an side view of a strain relief/bending protection apparatus in accordance with the invention in accordance with a second embodiment.
FIG. 2C is a top view of a strain relief/bending protection apparatus in accordance with the invention in accordance with a second embodiment.

It must be pointed out that the sleeve section 26 does not necessarily have to extend at a right angle to the main axis of the plug connector 14, but can also form different angles with the main axis of the plug connector 14 depending on the application. FIGS. 2A-2C, for example, thus show an embodiment in which the sleeve section 26 extends at an angle of approximately 45° to the main axis of the plug connector 14. It is generally also possible not to angle the sleeve section 26 at all, i.e. to configure it such that it extends coaxially with the main axis of the plug connector 14.

The sleeve section 26 has a round cross-section which is circular in the embodiment shown and tapers in the direction of its free end 28 remote from the base section 24, i.e. the cross-sectional area of the sleeve section 26 becomes smaller as the spacing from the base section 24 increases. Due to the circular shape of the cross-section of the sleeve section 26, the reduction in the cross-sectional area of the sleeve section in the embodiment shown is equivalent to a reduction of the diameter or of the wall thickness of the sleeve section 26.

As FIGS. 1A-1C show, the sleeve section 26 does not have a continuously reducing cross-sectional area extent, i.e. therefore not a frustoconical shape, which would easily be possible, but the cross-sectional area rather decreases step-wise in the embodiment shown.

Specifically, the shown embodiment has two steps, i.e. the sleeve section 26 is composed of three substantially hollow cylindrical part sections 30 of different wall thicknesses, with each part section 30 further remote from the base section 24 having a smaller wall thickness than the previous part section 30. The transition from one part section 30 to the next in this respect does not take place abruptly, but rather over an intermediate section 32 which has an obliquely sloping surface and thus so-to-say forms a frustoconical segment.

The number of part sections 30, the wall thicknesses of the individual part sections 30 and the lengths of the individual part sections 30 viewed in the cable direction, i.e. that is their axial dimensions, can be selected in dependence on the application, so that the sleeve section 26 has a desired bending characteristic overall and ensures an ideal protection of the cable 12 against cable breakage.

The embodiment of a strain relief/bending protection apparatus 10 shown in FIGS. 2A-2C only differs from the embodiment shown in FIGS. 1A-1C and described above in that the sleeve section 26 does not extend at a right angle to the main axis of the plug connector 14, but rather at an angle of approximately 45° thereto. The part sections 30 of the sleeve section 26 of the second embodiment furthermore have somewhat different dimensions than those of the first embodiment.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

REFERENCE NUMBER LIST

10 Strain Relief/Bending Protection Apparatus
12 Cable
14 Plug Connector
16 Housing
18 Front Side
20 Plug-In Contact
22 Rear Side
24 Base Section
26 Sleeve Section
28 Free End
30 Part Section
32 Intermediate Section

The invention claimed is:

1. A strain relief/bending protection apparatus for a cable connected to a connector, comprising:

a base section configured to be fastened to a housing of the plug connector; and a sleeve section projecting from the base section for surrounding the cable in a region disposed outside the housing, wherein the sleeve section has a continuously round cross-section and a cross-sectional area of the sleeve section reduces as the spacing from the base section increases, wherein the cross sectional area of the sleeve section decreases step wise while forming discrete part sections, wherein the cross sectional area of the sleeve section constantly decreases between the part sections, and wherein the sleeve portion is angled relative to the base portion and the strain relief/bending protection apparatus is formed by an injection molding process.

2. The apparatus in accordance with claim 1, wherein the sleeve section does not have any incisions or cut-outs.

3. The apparatus in accordance with claim 1, wherein the lengths of at least two part sections are different.

4. The apparatus in accordance with claim 1, wherein the cross-sectional shape of the sleeve section is selected from the group consisting of circular, oval, and ellipsoid.

5. The apparatus in accordance with claim 1, wherein the apparatus is formed of a plastic material.

6. The apparatus in accordance with claim 5, wherein the plastic material is polyvinyl chloride (PVC).

* * * * *